US008113269B2

(12) United States Patent
Specht

(10) Patent No.: US 8,113,269 B2
(45) Date of Patent: Feb. 14, 2012

(54) MULTI-CHANNEL HEAT EXCHANGER

(75) Inventor: Werner O. Specht, Hermitage, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 577 days.

(21) Appl. No.: 12/008,135

(22) Filed: Jan. 9, 2008

(65) Prior Publication Data

US 2008/0202736 A1 Aug. 28, 2008

Related U.S. Application Data

(60) Provisional application No. 60/902,763, filed on Feb. 22, 2007.

(51) Int. Cl.
*F28D 7/16* (2006.01)
*F24H 3/08* (2006.01)

(52) U.S. Cl. ..... 165/176; 126/110 R

(58) Field of Classification Search ..... 165/176, 165/174; 126/110 R
See application file for complete search history.

(56) References Cited

U.S. PATENT DOCUMENTS

| | | | | |
|---|---|---|---|---|
| 1,135,840 | A | | 4/1915 | Oudeville |
| 1,294,999 | A | | 1/1919 | Brickman |
| 1,328,589 | A | | 1/1920 | Roberts |
| 2,096,272 | A | | 10/1937 | Young |
| 2,151,540 | A | | 3/1939 | Varga |
| 2,611,359 | A | | 9/1952 | Scogin |
| 2,625,992 | A | | 1/1953 | Beck |
| 2,626,656 | A | | 1/1953 | Wyatt |
| 2,751,900 | A | | 6/1956 | Modine |
| 2,788,848 | A | | 4/1957 | Alfred |
| 3,411,716 | A | | 11/1968 | Stephan et al. |
| 3,451,472 | A | * | 6/1969 | Keck ..... 165/134.1 |
| 3,596,495 | A | | 8/1971 | Huggins |
| 3,603,384 | A | | 9/1971 | Huggins |
| 3,935,855 | A | | 2/1976 | Van Vliet |
| 4,106,559 | A | * | 8/1978 | Ritland et al. ..... 165/111 |
| 4,300,481 | A | * | 11/1981 | Fisk ..... 122/406.3 |
| 4,467,780 | A | | 8/1984 | Ripka |
| 4,738,307 | A | * | 4/1988 | Bentley ..... 165/133 |
| 4,825,941 | A | * | 5/1989 | Hoshino et al. ..... 165/176 |
| 4,860,725 | A | * | 8/1989 | Tallman et al. ..... 126/110 R |
| 4,945,890 | A | | 8/1990 | Ripka |
| 5,058,266 | A | | 10/1991 | Knoll |
| 5,094,224 | A | | 3/1992 | Diesch |
| 5,178,124 | A | * | 1/1993 | Lu et al. ..... 126/110 R |
| 5,186,246 | A | | 2/1993 | Halstead |
| 5,346,002 | A | | 9/1994 | Swilik et al. |
| 5,375,586 | A | | 12/1994 | Schumacher et al. |
| 5,437,263 | A | * | 8/1995 | Ellingham et al. ..... 126/110 R |
| 5,476,141 | A | | 12/1995 | Tanaka |

(Continued)

FOREIGN PATENT DOCUMENTS

DE 2354502 5/1975

(Continued)

*Primary Examiner* — Leonard R Leo
(74) *Attorney, Agent, or Firm* — Hoffmann & Baron, LLP

(57) ABSTRACT

A combustion gas furnace includes a plurality of primary heat exchangers for passage of combustion gases therethrough. A plurality of secondary heat exchangers receive the combustion gases from the primary heat exchanger. Each of the secondary heat exchangers includes a heat conductive element defining a plurality of elongate passageways for the flow of combustion gas therethrough. The passageways include aligned ports at either end thereof. The passageways are generally aligned and separated by longitudinal walls extending between the ends. The walls are positioned for heat conductive contact with the combustion gases flowing through passageways.

3 Claims, 5 Drawing Sheets

U.S. PATENT DOCUMENTS

| | | | | |
|---|---|---|---|---|
| 5,555,930 | A | 9/1996 | Lu | |
| 6,026,804 | A * | 2/2000 | Schardt et al. | 126/344 |
| 6,889,686 | B2 | 5/2005 | Specht | |
| 6,942,023 | B2 | 9/2005 | Fang et al. | |
| 7,059,399 | B2 | 6/2006 | Chin et al. | |
| 2003/0010480 | A1 | 1/2003 | Shibagaki et al. | |
| 2005/0092316 | A1 | 5/2005 | Schonberger, Sr. | |

FOREIGN PATENT DOCUMENTS

| | | |
|---|---|---|
| EP | 0 479 388 | 4/1992 |
| FR | 2 870 590 | 11/2005 |
| JP | 61-231351 | 10/1986 |
| JP | 06-249415 | 9/1994 |
| WO | WO 2007/137863 | 12/2007 |

* cited by examiner

MULTI-CHANNEL HEAT EXCHANGER

CROSS-REFERENCE TO RELATED APPLICATION

This application claims priority to U.S. Provisional Patent Application No. 60/902,763, filed on Feb. 22, 2007, herein incorporated by reference.

FIELD OF THE INVENTION

The present invention relates generally to a furnace heat exchanger. More particularly, the present invention is directed to a multi-channel heat exchanger for combustion gases.

BACKGROUND OF THE INVENTION

Heat exchangers are commonly used in gas fired hot air furnaces in both residential and commercial settings. Heat exchangers are generally divided into two types. The first includes tubular heat exchangers where a tube is formed in a serpentine configuration and hot combustion gases are allowed to propagate through the tube. The second type of heat exchanger includes a compact design which may have a clam shell construction.

In typical use in a furnace, a series of heat exchangers are provided in which hot combustion gases pass through the exchangers transferring heat to the surfaces of the heat exchanger. Forced air passed externally over the heated surfaces of heat exchangers is warmed and circulated into a room which is to be heated. The efficiency of the heat exchanger is dictated by the effectiveness of the transfer of heat from the hot combustion gases within a heat exchanger to the external surfaces of the heat exchanger itself.

Also, many furnaces employ secondary heat exchangers which are used to extract added heat from the combustion gas exiting the primary heat exchangers.

As may be appreciated, it is desirable to increase the heat transfer between the combustion gases and the walls of the primary and secondary heat exchangers.

One such example is shown in U.S. Pat. No. 6,938,688 which employs a clam shell design for primary heat exchangers where turbulent flow of the combustion gases is caused. This results in more efficient heat transfer.

However, as may be appreciated, such techniques may increase the size of the heat exchanger. Thus, additionally employing such a design for secondary heat exchangers would increase both the size and cost of the furnace.

It is, therefore, desirable to provide an increase in the heat transfer surface area of a heat exchanger that is exposed to the combustion gases without increasing the external size of the heat exchanger itself.

SUMMARY OF THE INVENTION

The present invention provides a heat exchanger which includes a heat conductive element defining a plurality of elongate passageways for the flow of combustion gases therethrough. The passageway includes aligned inlet ends and opposed aligned exhaust ends. The passageways are generally longitudinally aligned and separated by longitudinal wall extending between the ends. The walls are positioned for heat conductive transfer with the combustion gases flowing through the passageways.

The present invention also provides a combustion gas furnace including a heat exchanger support having means for accommodating a burner. A plurality of multi-channel heat exchangers are arranged in spaced apart succession along the support. Each heat exchanger includes a plurality of side-by-side channels. Each channel includes an inlet port at one end and an outlet port at the other. The channels are separated by integrally formed channel walls extending therealong.

DETAILED DESCRIPTION OF THE PREFERRED EMBODIMENT

The present invention provides a novel heat exchanger construction which may be used preferably as a secondary heat exchanger. While in the present illustrative embodiment, the novel heat exchangers are shown as secondary heat exchangers, it is contemplated that they also may be employed in certain situations as primary heat exchangers.

Figure 1:
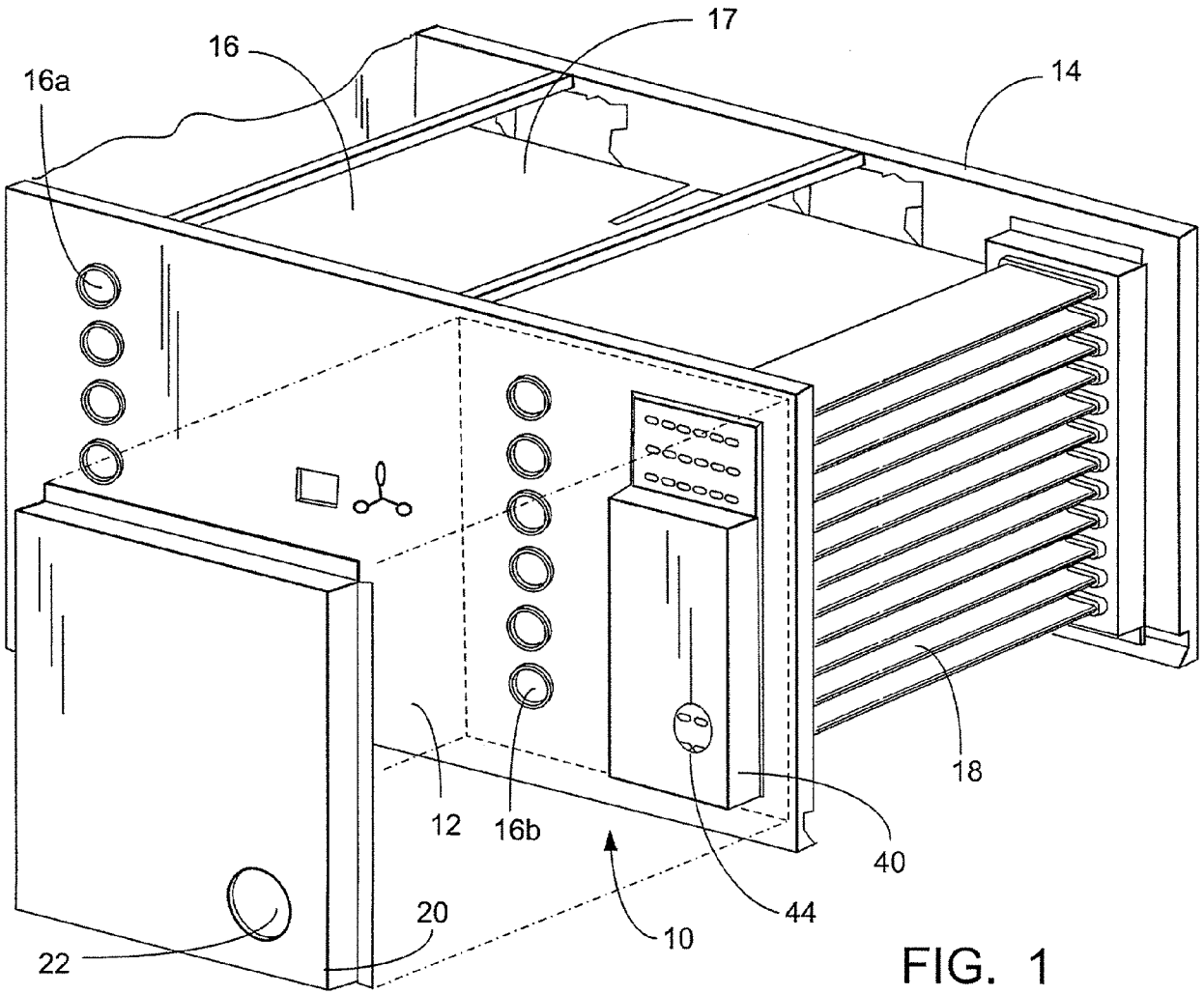
FIG. 1 is an exploded perspective view of a furnace employing the heat exchangers of the present invention.

Referring now to FIG. 1, a furnace 10 employing the heat exchanger of the present invention is shown. Furnace 10 includes a pair of spaced apart supporting walls 12 and 14 which support therebetween primary heat exchangers 16 and secondary heat exchangers 18. Each of the primary and secondary heat exchangers are formed of a heat conducting metal, preferably aluminum. The primary heat exchangers 16 may be of the type shown and described in commonly assigned U.S. Pat. No. 6,938,688, issued Sep. 6, 2005, and entitled "Compact High Efficiency Clam Shell Heat Exchanger". This patent is incorporated herein for all purposes.

Primary heat exchangers 16 may be aligned in vertically spaced succession and may be of the clam shell variety having an inlet port 16*a* at wall 12, a serpentine passageway 17, and an exhaust port 16*b* at the other end of the serpentine passageway 17 opening to wall 12. Combustion gases from a burner (not shown) enter the primary heat exchanger 16 through port 16*a* travel through the serpentine passageway 17 and exit exhaust ports 16*b*. In order to increase the efficiency of the furnace, secondary heat exchangers 18 are employed. Secondary heat exchangers 18 are designed to take the exhaust exiting outlet ports 16*b* and move the gases through the secondary heat exchangers so that the heat from the exhaust can be employed.

As is well known, a fan (not shown) may be supported by the furnace 10 to move air across the primary and secondary heat exchangers to provide warm air to the space to be heated.

The wall 12 of furnace 10 supports an exhaust chamber 20 which is disposed over the exhaust ports 16*b* and the ends of the secondary heat exchanger 18 to direct exhaust gases from the primary heat exchangers through the secondary heat exchangers in a manner which will be described in further detail hereinbelow. A fan or other similar device may be used to draw the exhaust gas through the primary and secondary heat exchangers.

Figure 2:
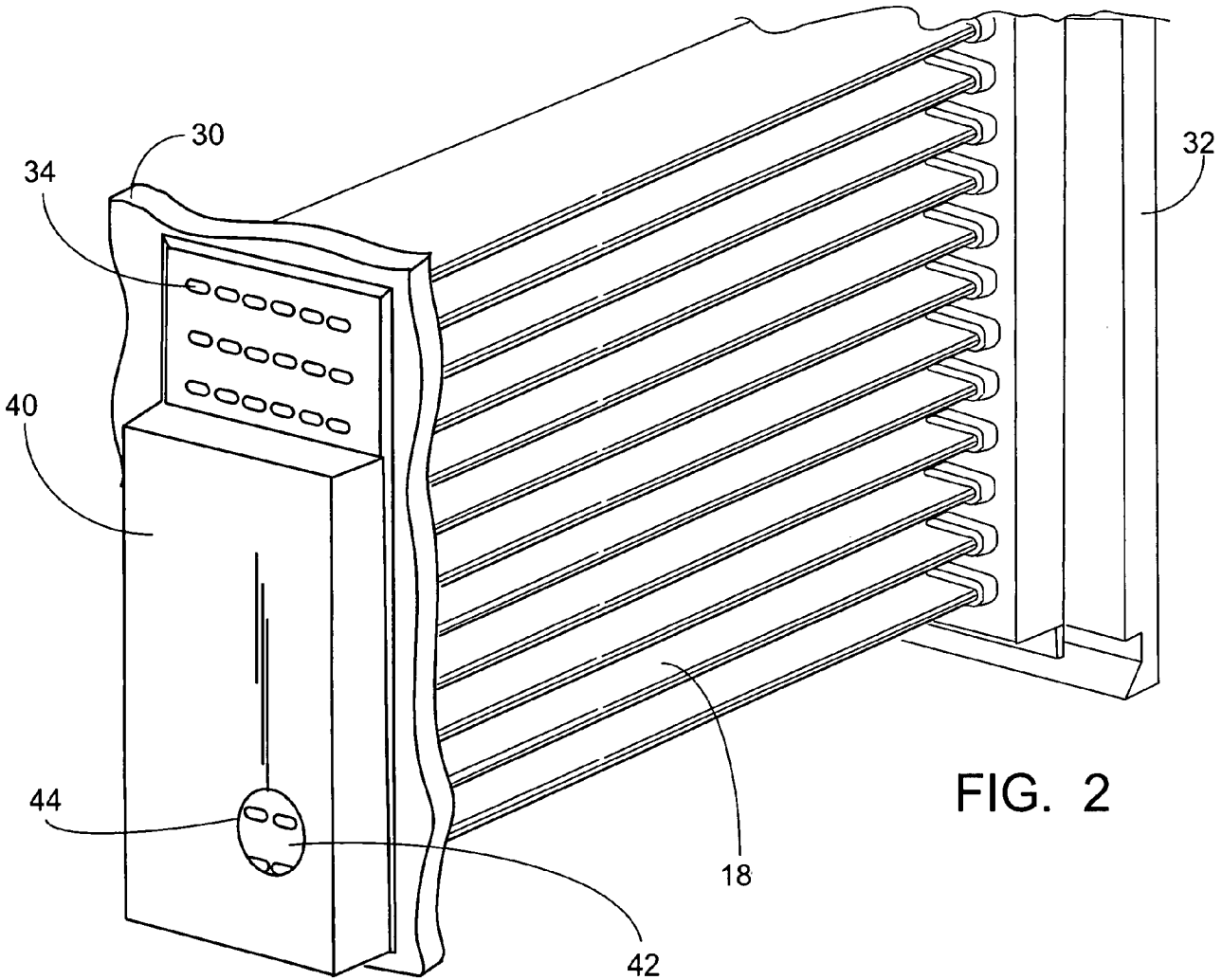
FIGS. 2 and 3 are front and rear a perspective showings respectively of the heat exchangers of the furnace of FIG. 1.
Figure 3:
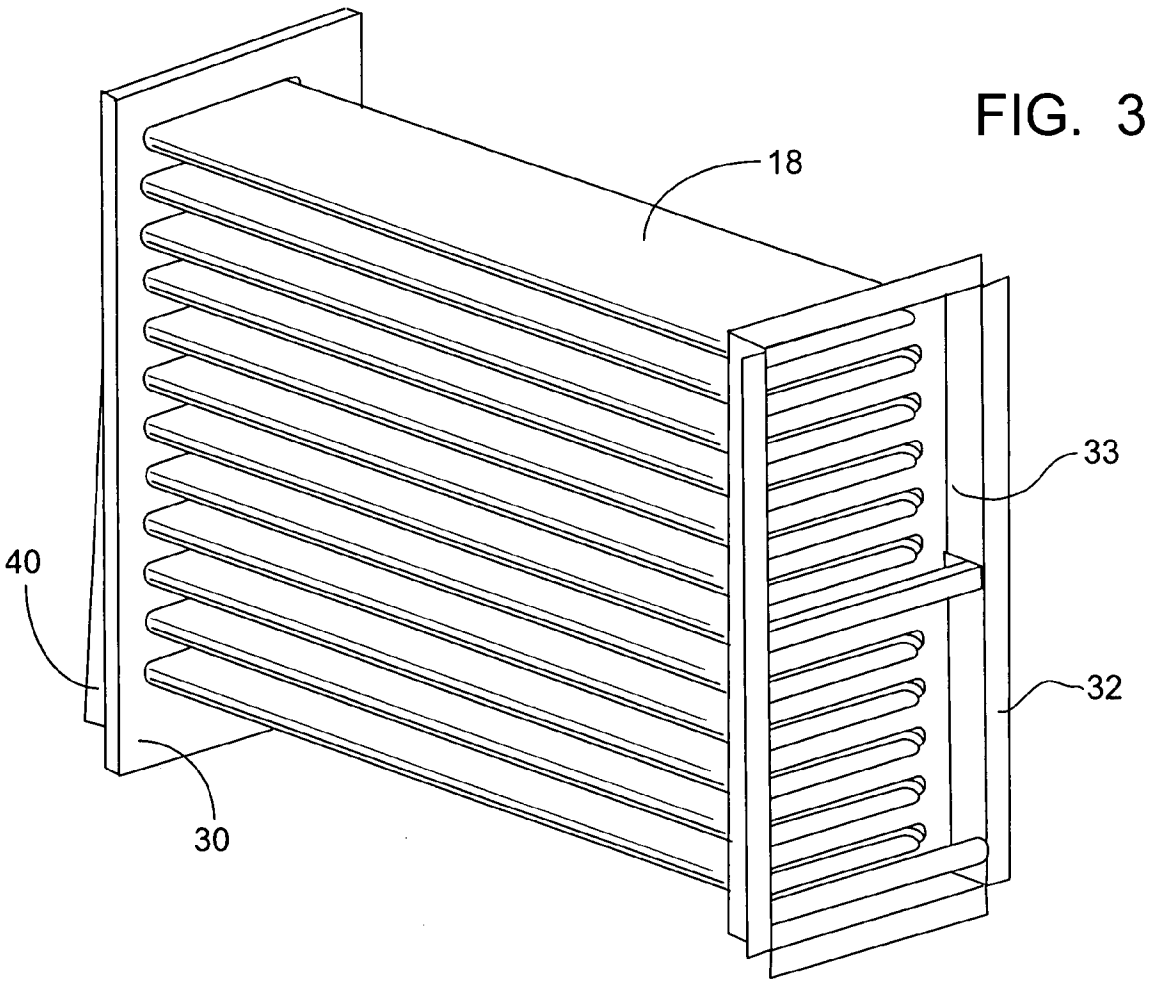
Figure 4:
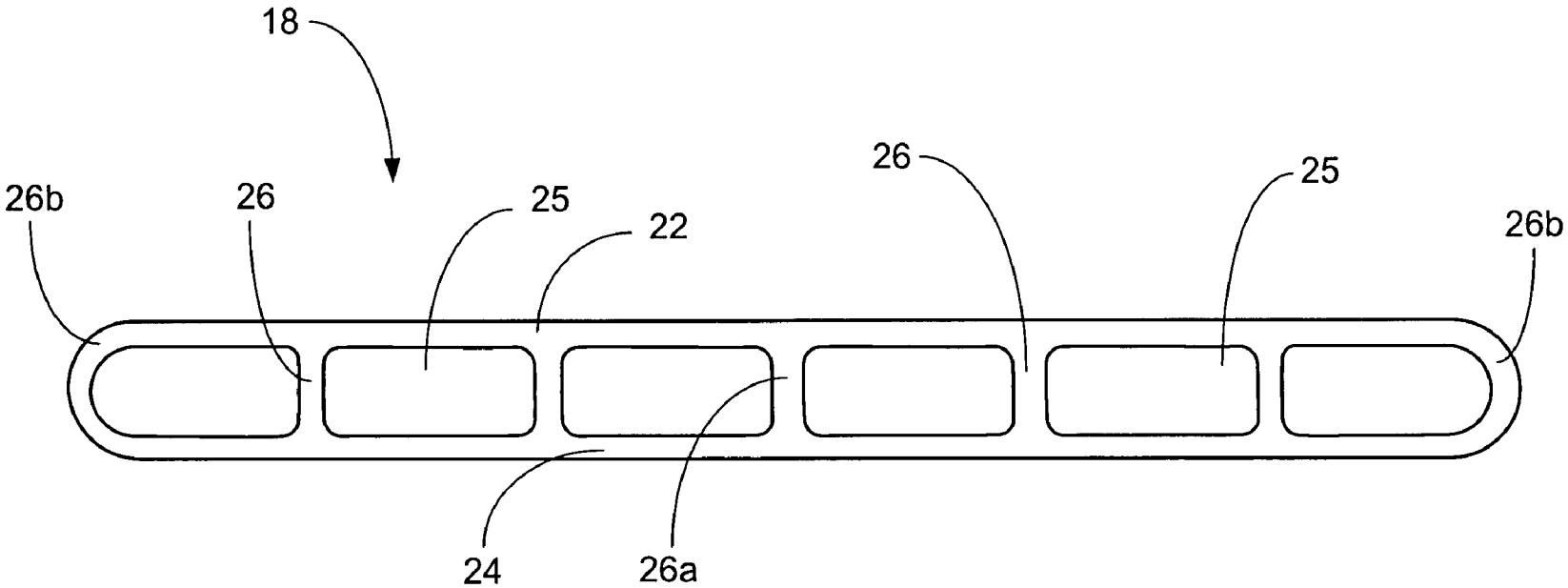
FIG. 4 is a cross sectional showing of one heat exchanger shown in FIG. 3.

Referring now to FIGS. 2-4, the secondary heat exchangers 18 of the present invention are shown. Each secondary heat exchanger 18 is an elongate integrally formed heat conductive metal member having a plurality of aligned channels therethrough.

Referring specifically to FIG. 4, each heat exchanger 18 includes a top wall 22, a bottom wall 24 and a plurality of integrally formed dividing walls 26 forming individual elongate channels 25. The number of such channels may be selected based upon space and heat efficiency needs. The centrally located walls 26*a* are generally planar and parallel to one another while the end walls 26*b* may include a curved configuration. The walls 26 divide the heat exchanger into smaller parallel channels which result in higher heat transfer efficiency while maintaining a compact overall configuration. Such an arrangement assures more wall contact between the surface of the heat exchanger and the gases passing therethrough. Moreover, the open area of the secondary heat exchanger is significantly less than the open area of the primary area heater and there is a relatively large pressure drop loss as the gases flow through the secondary heat exchanger tubes. The flow resistance through the secondary tubes causes a "balanced" flow through the tube. The gases "look" for the flow path of least resistance thus balancing the flow. Maintaining a high flow velocity significantly improves heat transfer. By increasing the number of passes without any increase in the size of the heat exchanger heat transfer is improved.

As shown in FIGS. 2 and 3, a plurality of such heat exchangers, in the present example 12, are arranged in a vertically stacked arrangement between support elements 30 and 32 supporting opposite ends of the heat exchangers 18. The support members are in turn supported by walls 12 and 14 of furnace 10 (FIG. 1). Each of the heat exchangers 18 is preferably formed of identical construction. The ends of the channels supported by the support members define ports 34 which provide for inlet or outlet of exhaust gases flowing within the channels 25. As shown in FIG. 4, the channels 25, being bounded by top and bottom walls 22 and 24, and dividing walls 26, effectively transfer the heat of the exhaust gases flowing therethrough to the walls. Also, by increasing the number of walls in contact with the exhaust gases, additional heat transfer to the surface of the heat exchanger is provided. Due to the compact size of the heat exchanger 18 and the effective transfer of heat to the walls thereof, an over all increase in heat transfer efficiency is achieved.

As noted above, the heat exchangers 18 are supported between support elements 30 and 32. Support element 30 supports one end of the heat exchangers with the ports 34 at that end being exteriorly accessible through the wall of the support 30. An exhaust gas chamber 40 is positioned on support wall 30 so as to overlie the ports of all but the upper three of the heat exchangers. The chamber has an interior 42 which is in fluid communication with the ports of the covered heat exchangers. The chamber 40 includes a lower exhaust opening 44 which will be described in further detail herein below.

The opposite ends of the heat exchangers are supported in support element 32. Support element 32 individually accommodates each end of all of the heat exchangers and defines a fluid chamber, the interior 33 of which is in communication with each of the ends of the heat exchanger ports supported therein. Thus, chamber 40 as well as the chamber defined by support 32 are in fluid communication through the heat exchangers supported therebetween.

Turning additionally again to FIG. 1, exhaust chamber 20 is positioned to overlie exhaust ports 16*b* as well as support 30 and the chamber 40 positioned thereover. Exhaust chamber 20 places each of the exhaust ports 16*b* and the heat exchanger ports 34 which are not covered by chamber 40, in fluid communication. Exhaust chamber 20 includes an exhaust opening 22 aligned with opening 44 of chamber 40. The exhaust chamber 20 allows exhaust gas exiting through ports 16*b* to be received within the ports 34 of the exposed heat exchangers 18 so that the exhaust gases traveling through heat exchangers 16 may be recaptured and used through secondary heat exchangers 18. This allows the furnace 10 of the present invention to extract additional energy from the flue gas exiting the primary heat exchangers 16.

Figure 5:
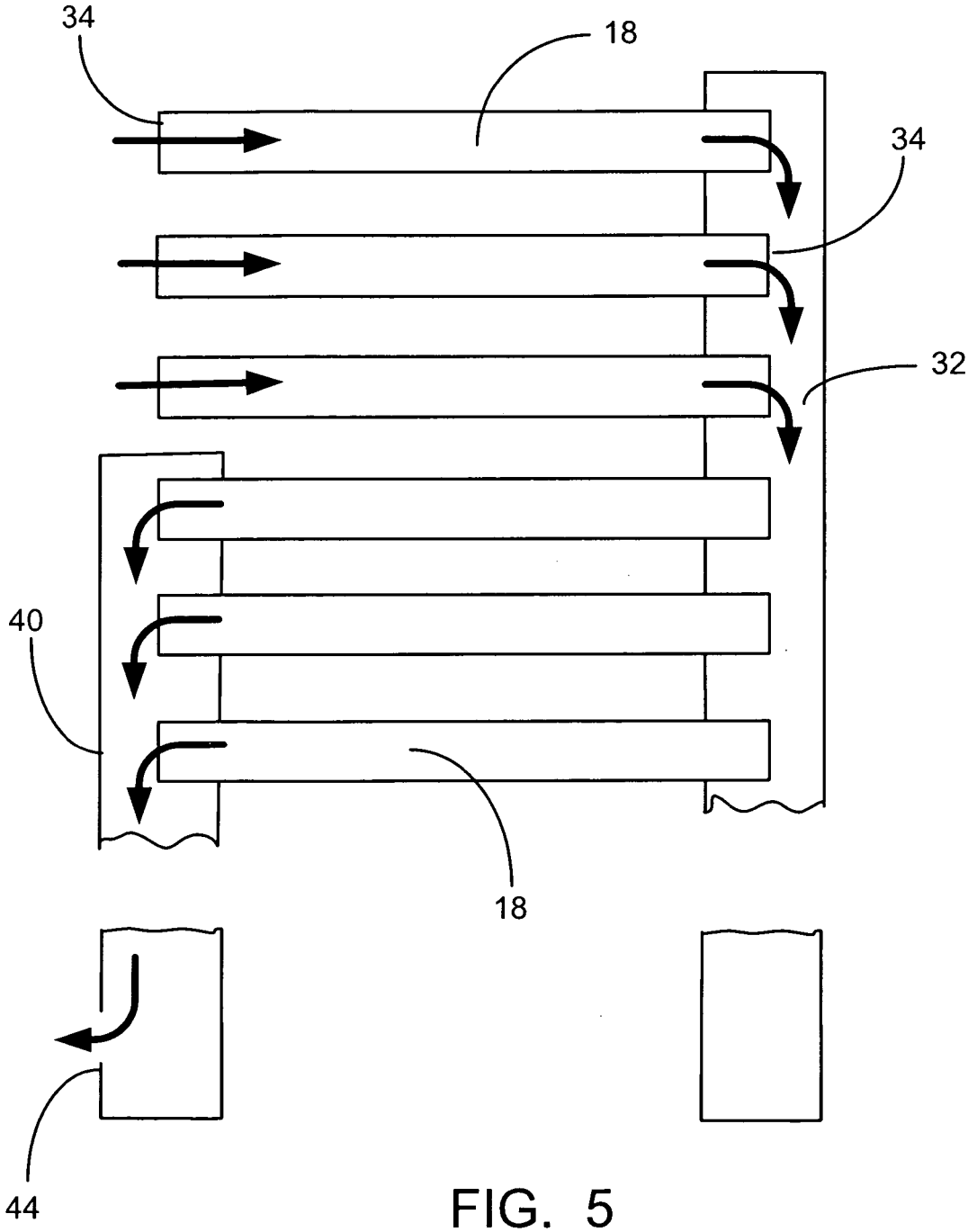
FIG. 5 is a schematic representation of the travel of the combustion gases through the heat exchangers of FIG. 4.

The flow of the exhaust gases through the secondary heat exchanger is shown schematically in FIG. 5. The exhaust gases which exit ports 16*b* (FIG. 1) from the primary heat exchangers 16 are directed to ports 34 of the upper three of the secondary heat exchangers 18. As noted above, a fan maybe used to directionally pull the exhaust gases. As shown by the arrows, the exhaust gases travel through the individual channels 25 (FIG. 4) of heat exchangers 18 transferring the heat of the exhaust gases to the walls of the secondary heat exchangers 18. The exhaust gases exit the opposite end of the heat exchangers 18 through ports 34 and are directed towards the next three heat exchangers immediately below. The exhaust gases thereupon enter ports 34 supported within support member 32 and travel along channels 25 again heating the walls therebetween. This travel of the exhaust gases continues in a serpentine fashion until finally the exhaust gases exit opening 44 in chamber 40 and are vented.

Thus, the present invention employs the exhaust gas exiting primary heat exchangers 16 to heat the secondary heat exchangers 18 to extract additional heat from the exhaust gas. Moreover, as the secondary heat exchangers place the exhaust gases in direct contact with multiple wall surfaces of the heat exchangers 18, the heat from the exhaust gas which would normally be directly vented may be efficiently employed in the furnace 10.

While the invention has been described in related to the preferred embodiments with several examples, it will be understood by those skilled in the art that various changes may be made without deviating from the fundamental nature and scope of the invention as defined in the appended claims.

What is claimed is:

1. A combustion gas furnace comprising:

a plurality of primary heat exchangers for passage of combustion gases therethrough; and a plurality of secondary heat exchangers for receiving said combustion gases from said primary heat exchangers and for passing said combustion gases therethrough;

each said secondary heat exchanger including a heat conductive element having first and second opposed ends and a plurality of aligned, side-by-side channels therebetween;

each said channel having an inlet port and an outlet port at said ends;

said channels being separated by channel walls therebetween;

each heat conductive element is an elongate integrally formed metal member;

wherein said secondary heat exchangers are supported in a vertically stacked arrangement between spaced apart support elements at opposite ends thereof, wherein each of said support elements includes a fluid chamber for providing fluid communication between said secondary heat exchangers, wherein a first of said fluid chambers encompasses the first ends of less than all of said secondary heat exchangers so as to place said first ends of less than all of said secondary heat exchangers in fluid communication, and a second of said fluid chambers encompasses the second ends of all of said secondary heat exchangers to place all of said second ends in fluid communication; and an exhaust chamber which is disposed over exhaust ports of the primary heat exchangers, over the first ends of said secondary heat exchangers which are not encompassed by said first fluid chambers, and over the first fluid chamber, to place each of the exhaust ports of the primary heat exchangers in fluid communication with each of the first ends of the secondary heat exchangers which are not encompassed by said first fluid chamber;

wherein said exhaust chamber includes an exhaust opening and said first fluid chamber includes an opening aligned with said exhaust opening.

2. A furnace of claim 1 wherein said channel walls of said secondary heat exchangers are generally parallel.

3. A furnace of claim 2 wherein said end walls of said secondary heat exchanger are curved.

* * * * *